US006334668B1

(12) United States Patent
Isamoto

(10) Patent No.: US 6,334,668 B1
(45) Date of Patent: Jan. 1, 2002

(54) INK-JET RECORDING APPARATUS

(75) Inventor: Hideyuki Isamoto, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/701,482

(22) PCT Filed: Mar. 28, 2000

(86) PCT No.: PCT/JP00/01904

§ 371 Date: Nov. 29, 2000

§ 102(e) Date: Nov. 29, 2000

(87) PCT Pub. No.: WO00/58097

PCT Pub. Date: Oct. 5, 2000

(30) Foreign Application Priority Data

Mar. 29, 1999 (JP) ..... 11-086922

(51) Int. Cl.[7] ..... B41J 2/05; B41J 2/045

(52) U.S. Cl. ..... 347/57; 347/68

(58) Field of Search ..... 347/9, 14, 17, 347/19, 56–59, 10, 68, 70–72

*Primary Examiner*—John Barlow
*Assistant Examiner*—Juanita Stephens
(74) *Attorney, Agent, or Firm*—Sughrue Mion, PLLC

(57) ABSTRACT

To provide an ink jet recording apparatus wherein distorting the waveform of a drive signal can be prevented, a recording head also containing a drive signal generating circuit can be tested, and the detrimental effect when such a configuration is adopted can be avoided. In the ink jet recording apparatus, a heat radiation member 200 is placed in a recording head 100 and an IC 300 is mounted on a vertical plate section 210 of the heat radiation member 200. The IC 300 is provided with not only a head drive circuit, but also a current amplification circuit of a drive signal generating circuit for generating a drive signal to drive a pressure generating element 17. The recording head 10 is attached to a carriage in a state in which the vertical plate section 210 of the heat radiation member 200 is brought into contact with the carriage with heat radiation fins.

19 Claims, 13 Drawing Sheets

2
3
I/F
4
RAM
RECEPTION BUFFER
INTERMEDIATE BUFFER
OUTPUT BUFFER
4A
4B
4C
5
ROM
6
CONTROL SECTION
7
OSCILLATION CIRCUIT
CLK
9
I/F
SI
VM
LAT
CLK
100
CARRIAGE
12
PAPER FEED
11
10
8
80
89
COM
WAVEFORM GENERATING CIRCUIT
13
SHIFT REGISTER
DATA LATCH
14
LEVEL SHIFTER
15
16
17
17
18

INK-JET RECORDING APPARATUS

TECHNICAL FIELD

The present invention relates to an ink jet recording apparatus such as an ink jet printer or an ink jet plotter. More particularly, the present invention relates to the structure of a recording head in an ink jet recording apparatus.

BACKGROUND ART

Hitherto, in an ink jet recording apparatus such as an ink jet printer or an ink jet plotter, as shown in FIG. 12, in a drive signal generating circuit 8 formed in a apparatus main unit 2, a drive signal COM generated by a waveform generating circuit 80 is amplified by a current amplification circuit 89 using push-pull-connected transistors, etc., for example, then is output to a recording head 10 mounted on a carriage. The recording head 10 is provided with a plurality of pressure generating elements 17 for jetting ink drops from nozzle openings by pressurizing ink in pressure generating chambers and a head drive circuit 18 for selecting which of the plurality of pressure generating elements 17 to drive based on recording data, and the drive signal COM is applied to the pressure generating element 17 selected by the head drive circuit 18. As a result, the selected pressure generating element 17 pressurizes ink in the corresponding pressure generating chamber for jetting ink as an ink drop from the nozzle opening.

Here, the apparatus main unit 2 and the recording head 10 are connected by a flexible wiring board 100 having a length sufficient for the carriage to move, and the drive signal generating circuit 8 formed in the apparatus main unit 2 outputs a signal to the recording head 10 via the flexible wiring board 100.

FIGS. 13(A) and (B) show an example of a schematic structure of the recording head 10 in the conventional art. As shown in FIGS. 13(A) and (B), the recording head 10 has a flow passage unit 230, which comprises a nozzle plate 233 provided with a plurality of nozzle openings 231 as nozzle rows 232, a flow passage formation board 237 comprising pressure generating chambers 234 communicating with the nozzle openings 231 and reservoirs 236 for supplying ink to the pressure generating chambers 234 through ink supply ports 235, and an elastic plate 240 for abutting the tip of each piezoelectric vibrator 239 in a vertical vibration mode of piezoelectric vibration units 238 corresponding to the pressure generating elements 17 previously described with reference to FIG. 12 for expanding or shrinking the pressure generating chamber 234, the nozzle plate 233, the flow passage formation board 237, and the elastic plate 240 being stacked in one piece. The flow passage unit 230 is connected to a holder 241 formed by injection molding, etc., of a polymeric material and each piezoelectric vibration unit 238 is connected to a flexible cable 242 for communicating an external drive signal, then they are housed in a housing chamber 243, the abutment faces (not shown) against the holders 241 are fixed with an adhesive, and a frame 244 also serving as a shield material is inserted into the nozzle plate 233, forming the recording head 10. The holder 241 is provided with an ink lead passage 245 communicating with an external ink tank (not shown) and the tip is connected to an ink introduction port 246 of the flow passage unit 230 for supplying ink from the ink tank to the flow passage unit 230.

Each piezoelectric vibrator 239 in the vertical vibration mode forming a part of the piezoelectric vibration unit 238 is formed by stacking an electrode as one pole and an electrode as an opposite pole like a sandwich via a piezoelectric material, exposing one electrode to the tip side and the opposite electrode to the rear end side, and connecting to a segment electrode and a common electrode on each end face with piezoelectric constant d31, for example, although not shown, and is fixed to a fix board 247 matching the arrangement pitch of the pressure generating chamber 234 as a part of the piezoelectric vibration unit 238.

The segment electrode and common electrode (not shown) of each piezoelectric vibrator 239 of the piezoelectric vibration unit 238 are connected to a conductive pattern for drive signal transmission of the flexible cable 242 via a solder layer. With the flexible cable 242, a window 248 is formed in an area facing the fix board 247, a semiconductor IC (integrated circuit) 249 provided with the head drive circuit 18 (see FIG. 12) for converting a print signal into a drive signal for driving each piezoelectric vibrator 239 is installed in the window, and the print signal is transmitted to the semiconductor IC (integrated circuit) 249 according to conductive pattern from the external drive signal generating circuit 8 (see FIG. 12) and the head drive signal is supplied to each piezoelectric vibrator 239.

Thus, a plurality of pressure generating elements 17 (piezoelectric vibration units 238) and head drive circuits 18 (semiconductor ICs 249) are formed on the recording head 10 and mainly the transistors of the head drive circuits 18 (semiconductor ICs 249) generate heat and therefore hitherto, a heat radiation measure has been taken for the recording head 10.

That is, for the semiconductor IC (integrated circuit) 249 mounted on the flexible cable 242, the area exposed from the window 248 is fixed to the fix board 247 with an adhesive via a thermal-conductivity fluid layer (for example, silicon grease, etc.,) not shown or is fixed with an adhesive having high thermal conductivity to the fix board 247. The fix board 247 functions as a heat radiation member and is made of a material having high thermal conductivity such as metal or alumina. As shown in FIG. 13(A), the fix board 247 is placed close to the ink lead passage 245, whereby ink flowing through the ink lead passage 245 absorbs heat generated on the semiconductor IC 249 via the fix board 247.

At the printing time, upon reception of input of a print signal via the flexible cable 242 from the external drive signal generating circuit 8 (see FIG. 12), the semiconductor IC (integrated circuit) 249 generates a drive signal for driving each piezoelectric vibrator 239 and supplies the drive signal to each piezoelectric vibrator 239. Thus, mainly the transistors in the head drive circuit 18 generate heat and the heat has thermal conduction relationship with the semiconductor IC (integrated circuit) 249 forming the head drive circuit 18 and is absorbed by the heat sink action of the fix board 247 having a large heat capacity and is radiated through the fix board 247, so that the semiconductor IC (integrated circuit) 249 can be prevented from leading to thermal runaway or damage.

In the conventional art example described above, the recording head 10 is provided with the head drive circuit 18. However, if the drive signal COM is output from the apparatus main unit 2 to the recording head 10 with the long flexible wiring board 100, there is a problem of distorting the waveform of the drive signal COM because of parasitic inductance, etc., of the flexible wiring board 100. For the recording head 10, characteristics vary from one head to another, thus previous inspection is executed for ranking for matching with the drive signal COM, but the characteristics of the semiconductor IC 249 forming the drive signal generating circuit 8 also vary from one product to another, thus the drive signal COM output from the drive signal generating circuit 8 and the recording head 10 do not match in some cases.

In the conventional art example described above, as shown in FIGS. 13(A) and (B), the adjacent nozzle rows 232 and 232 each formed with a plurality of nozzle openings 231 are formed comparatively close to each other in the nozzle plate 233, thus it is feared that to jet an ink drop from a predetermined nozzle opening 231 in one nozzle row 232, vibration excited by the corresponding piezoelectric vibration unit 238 may affect the other nozzle row 232 (pressure generating chamber 234) and an ink drop whose amount is extremely small may be jetted from the nozzle opening 231 in the other nozzle row 232, causing erroneous print to occur.

Further, combined with high image quality of print precision, the number of nozzle openings 231 in one nozzle row 232 is increased, for example, from 32 to 64 and can become 128 or more, thus it is expected that the number of transistors integrated in the semiconductor IC (integrated circuit) 249 will also never grow, thus a further heat radiation measure in the recording head 10 is desired.

It is therefore a first object of the present invention to provide an ink jet recording apparatus having a configuration wherein distorting the waveform of a drive signal can be prevented and a recording head also containing a drive signal generating circuit can be tested.

It is a second object of the present invention to provide an ink jet recording apparatus having a configuration wherein vibration excited by a piezoelectric vibration unit 238 can be effectively prevented from affecting another nozzle row, causing erroneous print to occur.

Further, it is a third object of the present invention to provide an ink jet recording apparatus having a configuration wherein the heat radiation effect in a recording head 10 can be more enhanced and particularly the detrimental effect when the configuration to accomplish the first object is adopted can be avoided.

DISCLOSURE OF THE INVENTION

To achieve the first object, according to the present invention, there is provided an ink jet recording apparatus comprising a recording head comprising a plurality of pressure generating elements for pressurizing ink in pressure generating chambers, thereby jetting ink drops from nozzle openings and a head drive circuit for selecting which of the plurality of pressure generating elements a drive signal is to be applied to based on recording data and a drive signal generating circuit for outputting the drive signal, the drive signal generating circuit comprising at least a waveform generating circuit for generating the drive signal and a current amplification circuit for executing current amplification of the drive signal generated by the waveform generating circuit and outputting the result, characterized in that the current amplification circuit is formed on a side of the recording head.

In the present invention, the current amplification circuit corresponding to the last stage, of the drive signal generating circuit is formed in the recording head, so that the drive signal after undergoing current amplification is output to the head drive circuit in the recording head and is not output via the flexible wiring board connecting the apparatus main unit and the recording head. Therefore, a problem of distorting the waveform of the drive signal after undergoing current amplification because of parasitic inductance, etc., of the flexible wiring board can be solved. When the recording head is tested for characteristics, the recording head also containing the current amplification circuit of the drive signal generating circuit is tested for characteristics, so that the characteristics of the recording head also containing those of the drive signal generating circuit can be determined properly. Therefore, a proper drive signal can be applied to each pressure generating element in the recording head.

Here, if the current amplification circuit is formed in the recording head, heat generation of the recording head becomes large. In the present invention, however, the heat radiation member is placed in the recording head to achieve the third object, so that a temperature rise in the recording head can be prevented. Therefore, in the recording head, each circuit can be prevented from malfunctioning or being degraded because of heat, and the detrimental effect of hastening drying of ink in the presence of heat or the like can be avoided.

In the present invention, preferably the waveform generating circuit is also formed on the side of the recording head. In such a configuration, the drive signal before undergoing current amplification is also output to the head drive circuit in the recording head and is not output via the flexible wiring board connecting the apparatus main unit and the recording head. Therefore, a problem of distorting the waveforms of the drive signals before and after undergoing current amplification because of parasitic inductance, etc., of the flexible wiring board can be solved. When the recording head is tested for characteristics, the recording head also containing the waveform generating circuit and the current amplification circuit of the drive signal generating circuit is tested for characteristics, so that the characteristics of the recording head also containing those of the drive signal generating circuit can be determined properly. Therefore, a proper drive signal can be applied to each pressure generating element in the recording head.

To achieve the second object, in the present invention, preferably the nozzle openings are formed in a flow passage unit as a plurality of nozzle rows in parallel and the heat radiation member is in contact with at least the area corresponding to the area between the plurality of nozzle rows in the flow passage unit. In such a configuration, interference occurring between the nozzle rows can be suppressed by means of the heat radiation member.

To achieve the third object, in the present invention, the heat radiation member may comprise at least a horizontal plate section in face contact with a carriage on which the recording head is mounted and a vertical plate section extended so as to be in contact with the area corresponding to the area between the nozzle rows in the flow passage unit from the horizontal plate section, and an IC, in which at least the head drive circuit and the current amplification circuit are formed, may be mounted onto the vertical plate section. In such a configuration, the carriage and the heat radiation member can be brought into contact with each other for escaping heat from the heat radiation member to the carriage, so that a temperature rise in the recording head can be prevented. Therefore, in the recording head, each circuit can be prevented from malfunctioning or being degraded because of heat, and the detrimental effect of hastening drying of ink in the presence of heat or the like can be avoided.

In the present invention, preferably heat radiation fins are formed in the carriage. In such a configuration, a temperature rise in the recording head can be suppressed furthermore effectively.

In the present invention, preferably, using the fact that the current amplification circuit is formed in the recording head, output of the waveform generating circuit is input into the current amplification circuit via switching elements of the switch circuit of the head drive circuit. In such a configuration, a signal before undergoing current amplification is input into the switching elements of the head drive circuit, thus heat generation of the switching elements of the head drive circuit is small. Therefore, small-sized elements can be used as the switching elements of the head drive circuit.

To achieve the third object, according to another aspect of the present invention, there is provided an ink jet recording apparatus comprising a recording head comprising a plurality of pressure generating elements for pressurizing ink introduced into pressure generating chambers via an ink lead passage, thereby jetting ink drops from nozzle openings and a semiconductor device containing a head drive circuit for selecting which of the plurality of pressure generating elements a drive signal is to be applied to based on recording data and a drive signal generating circuit for outputting the drive signal, the drive signal generating circuit comprising at least a waveform generating circuit for generating the drive signal and a current amplification circuit for executing current amplification of the drive signal generated by the waveform generating circuit and outputting the result, characterized in that the current amplification circuit and the waveform generating circuit are also formed so as to be contained in the semiconductor device of the recording head, and the recording head has a heat radiation member for the semiconductor device.

In the present invention, preferably the heat radiation member comprises at least a horizontal plate section in face contact with a carriage on which the recording head is mounted and a vertical plate section extended from the horizontal plate section to the flow passage unit, and the semiconductor device is mounted onto the vertical plate section.

Further, in the present invention, preferably a first heat insulation material is attached between the vertical plate section of the heat radiation member and the area corresponding to the area between the nozzle rows in the flow passage unit. The first heat insulation material thermally insulates the vertical plate section and the flow passage unit and the heat generated by the semiconductor device of the recording head is escaped upwardly through the vertical plate section of the heat radiation member and is effectively radiated through the horizontal plate section of the heat radiation member. Since the heat insulation material is provided, the heat generated by the semiconductor device can be efficiently prevented from being transmitted to the ink flow passage.

In the present invention, preferably the heat resistance ratio between the first heat insulation material and the heat radiation member is at least larger than 4:1, because if the heat generated by the IC reaches 150° C., for example, the heat transmitted to the flow passage unit side can be suppressed to ⅕ or less.

In the present invention, preferably the ink lead passage is placed away from the semiconductor device. Further, in the present invention, the ink lead passage may be placed so as to be extended up and down between the semiconductor device and the pressure generating element. Since the ink lead passage is placed away from the semiconductor device (heat source), the heat generated by the semiconductor device (heat source) can be prevented from being transmitted to the ink flow passage. On the other hand, in the present invention, the surroundings of the semiconductor device may be covered with a second heat insulation material. Heat conduction to the ink lead passage is furthermore suppressed and it is also made possible to escape heat to the upper side more reliably.

In the present invention, first heat radiation fins may be formed in the carriage. Heat is radiated furthermore effectively through the first heat radiation fins of the carriage from the horizontal plate section of the heat radiation member.

In the present invention, second heat radiation fins may be formed on the upper surface side of the horizontal plate section of the heat radiation member. Thus, the heat radiation effect can be enhanced furthermore.

Preferably, in the present invention, the second heat radiation fins are formed in parallel in a move direction of the carriage, other fins are formed lower than the two fins at both ends so that only the two fins at both ends support an ink tank made of a resin for supplying ink to the ink lead passage of the recording head, and a space is provided between other fins and a bottom of the ink tank. While heat conduction to the ink tank is suppressed because the resin has a heat insulation effect, wind flows through the space between other fins and the bottom of the ink tank as the carriage is moved, so that the heat radiation effect is enhanced dramatically.

EMBODIMENTS

Referring to the accompanying drawings, ink jet recording apparatuses incorporating the present invention will be discussed

First Embodiment

General Configuration of Ink Jet Recording Apparatus

Figure 1:
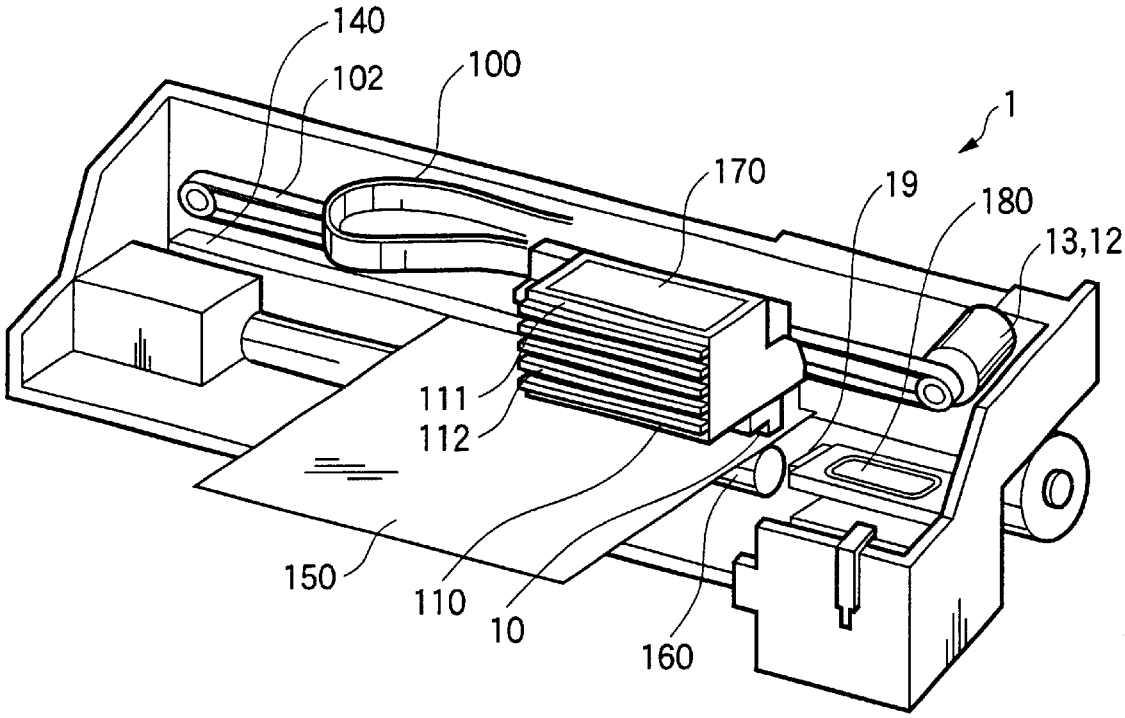
FIG. 1 is a perspective view of an ink jet recording apparatus according to a first embodiment of the present invention.

FIG. 1 is a perspective view to show the main part of an ink jet recording apparatus.

As shown in FIG. 1, in an ink jet recording apparatus 1, a carriage 110 is connected to a carriage motor 13 of a carriage mechanism 12 by a timing belt 102 and is guided by a guide member 140 so as to be reciprocated in the paper width direction of recording paper 150. The ink jet recording apparatus 1 is also provided with a paper feeding mechanism 11 using a paper feeding roller 160. An ink jet recording head 10 is attached to the face of the carriage 110 opposed to the recording paper 150, in the example shown in the figure, the lower face of the carriage. The recording head 10 receives supply of ink from an ink cartridge 170 placed on the upper portion of the carriage 110 and jets ink drops onto the recording paper 150 for forming dots for printing an image or a character as the carriage 110 is moved. A capping unit 180 is formed in a non-print area (non-recording area) of the ink jet recording apparatus 1 for sealing nozzle openings of the recording head 10 during quiescent operation of printing.

Therefore, an increase in the viscosity of ink or formation of an ink film because of scattering of a solvent from ink during the quiescent operation of printing can be suppressed for preventing the nozzles from being clogged during the quiescent operation of printing. The capping unit 180 receives ink drops from the recording head 10 produced by the flushing operation performed during the print operation. A wiping unit 19 is placed in the proximity of the capping unit 180 and wipes the surface of the recording head 10 with a blade, etc., thereby wiping out ink drops, paper powder, etc., deposited on the surface of the recording head 10.

Figure 2:
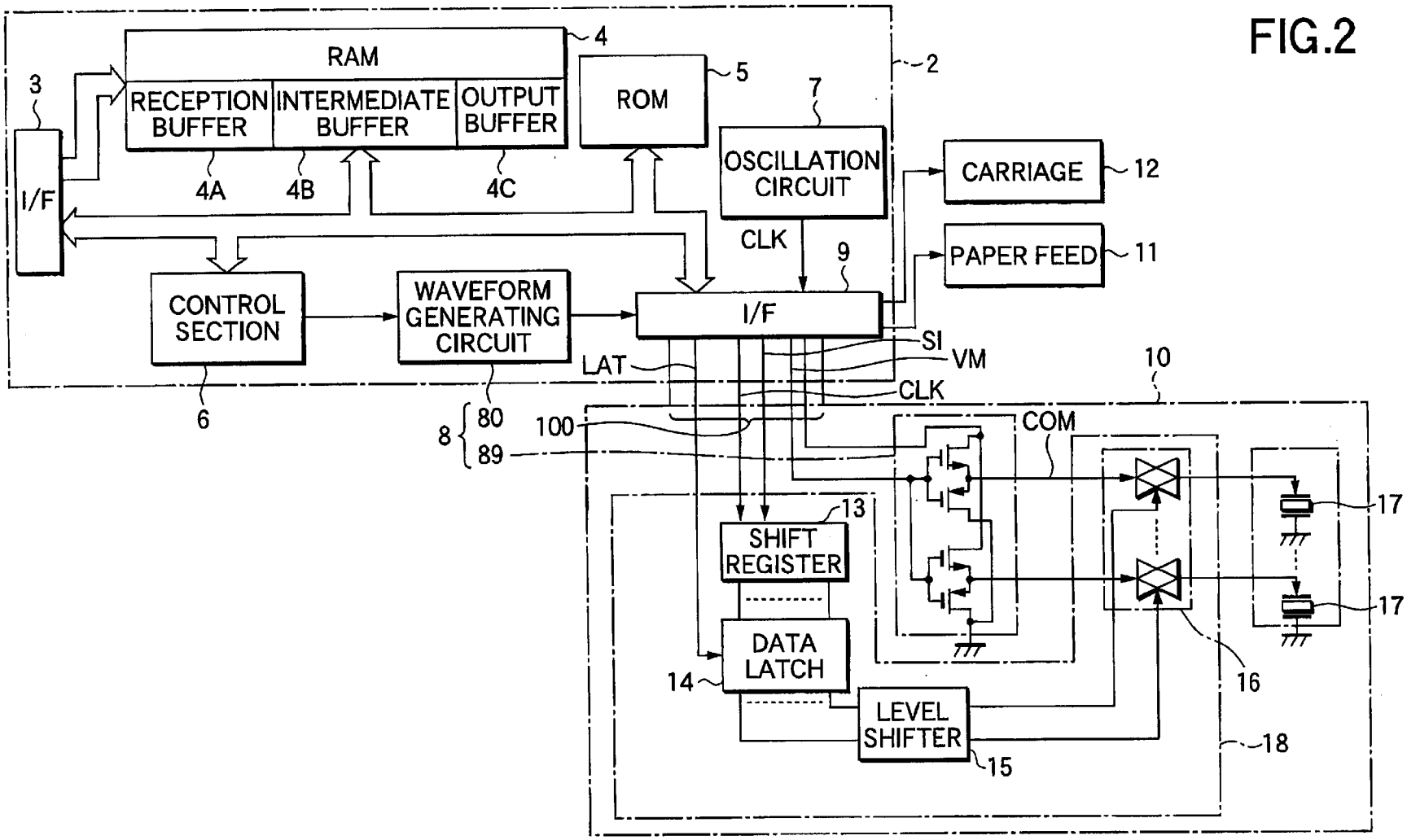
FIG. 2 is a functional block diagram of the ink jet recording apparatus shown in FIG. 1.

FIG. 2 is a functional block diagram of the ink jet recording apparatus 1 of the embodiment.

In FIG. 2, the ink jet recording apparatus 1 is made up of a apparatus main unit 2, the carriage mechanism 12, the paper feeding mechanism 11, and the recording head 10. The paper feeding mechanism 11 consists of a paper feeding motor (not shown), the paper feeding roller 160, and the like as previously described with reference to FIG. 1 and feeds recording media of the recording paper 150, etc., in order for executing subscanning. The carriage mechanism 12 consists of the carriage 110 on which the recording head 10 is mounted, the carriage motor 13 for running the carriage 110 via the timing belt 102, and the like for executing main scanning of the recording head 10.

The apparatus main unit 2 comprises an interface 3 for receiving recording data, etc., containing multilevel hierarchical information from a host computer (not shown), etc., RAM 4 for storing various kinds of data of recording data, etc., containing multilevel hierarchical information, ROM 5 storing routines, etc., for performing various types of data processing, a control section 6 consisting of a CPU, etc., an oscillation circuit 7, and an interface 9 bearing the function of transmitting print data SI (recording data) expanded to dot pattern data to the recording head 10, etc.

Here, the circuitry of the recording head 10 is connected to the apparatus main unit 2 by the flexible wiring board 100. As the flexible wiring board 100, a long wiring board is used so as not to hinder a move of the carriage 110, as shown in FIG. 1.

In the described ink jet recording apparatus 1, recording data containing multilevel hierarchical information sent from the host computer, etc., is retained in a reception buffer 4A in the recording apparatus via the interface 3. The recording data retained in the reception buffer 4A undergoes command analysis, then is sent to an intermediate buffer 4B. In the intermediate buffer 4B, the recording data in an intermediate format converted into intermediate code by the control section 6 (drive control circuit) is retained and processing of adding the print position of each character, qualification type, size, font address, etc., is executed by the control section 6. Next, the control section 6 analyzes the recording data in the intermediate buffer 4B and expands and stores binarized dot pattern data after hierarchical data is decoded in an output buffer 4C as described later.

When dot pattern data corresponding to one scan of the recording head 10 is provided, the dot pattern data is serially transferred to the recording head 10 via the interface 9. When the dot pattern data corresponding to one scan is output from the output buffer 4C, the contents of the intermediate buffer 4B are erased and the next intermediate code conversion is executed. Here, the print data expanded to the dot pattern data is made up of two bits, for example, as gradation data for each nozzle, as described alter.

The recording head 10 has a large number of nozzle openings, for example, 48 nozzle openings in the subscanning direction for jetting ink drops from the nozzle openings at a predetermined timing. The recording head 10 comprises a head drive circuit 18 consisting of a shift register 13, a latch circuit 14, a level shifter 15, and a switch circuit 16. The print data expanded to the dot pattern data by the apparatus main unit 2 is serially transferred from the interface 9 to the shift register 13 in synchronization with a clock signal (CLK) from the oscillation circuit 7. The serially transferred print data (SI/recording data) is once latched by the latch circuit 14. The latched print data SI is boosted by the level shifter 15, which is a voltage amplifier, to a voltage capable of driving the switch circuit 16, for example, a predetermined voltage of about several ten volts. The print data SI boosted to the predetermined voltage is given to the switch circuit 16. A drive signal (COM) from a drive signal generating circuit 8 is applied to input of the switch circuit 16 and piezoelectric vibrators as pressure generating elements 17 are connected to output of the switch circuit 16.

The print data SI controls the operation of the switch circuit 16. For example, while the print data applied to the switch circuit 16 is "1," the drive signal COM is applied to the pressure generating element 17 and the pressure generating element 17 is expanded or shrunk in response to the signal. As a result, ink in the pressure generating chamber is pressurized and is jetted from the nozzle opening. On the other hand, while the print data applied to the switch circuit 16 is "0," supply of the drive signal COM to the piezoelectric vibrator 17 is shut off and thus no ink drop is jetted.

Configuration of Drive Signal Generating Circuit 8

Figure 3:
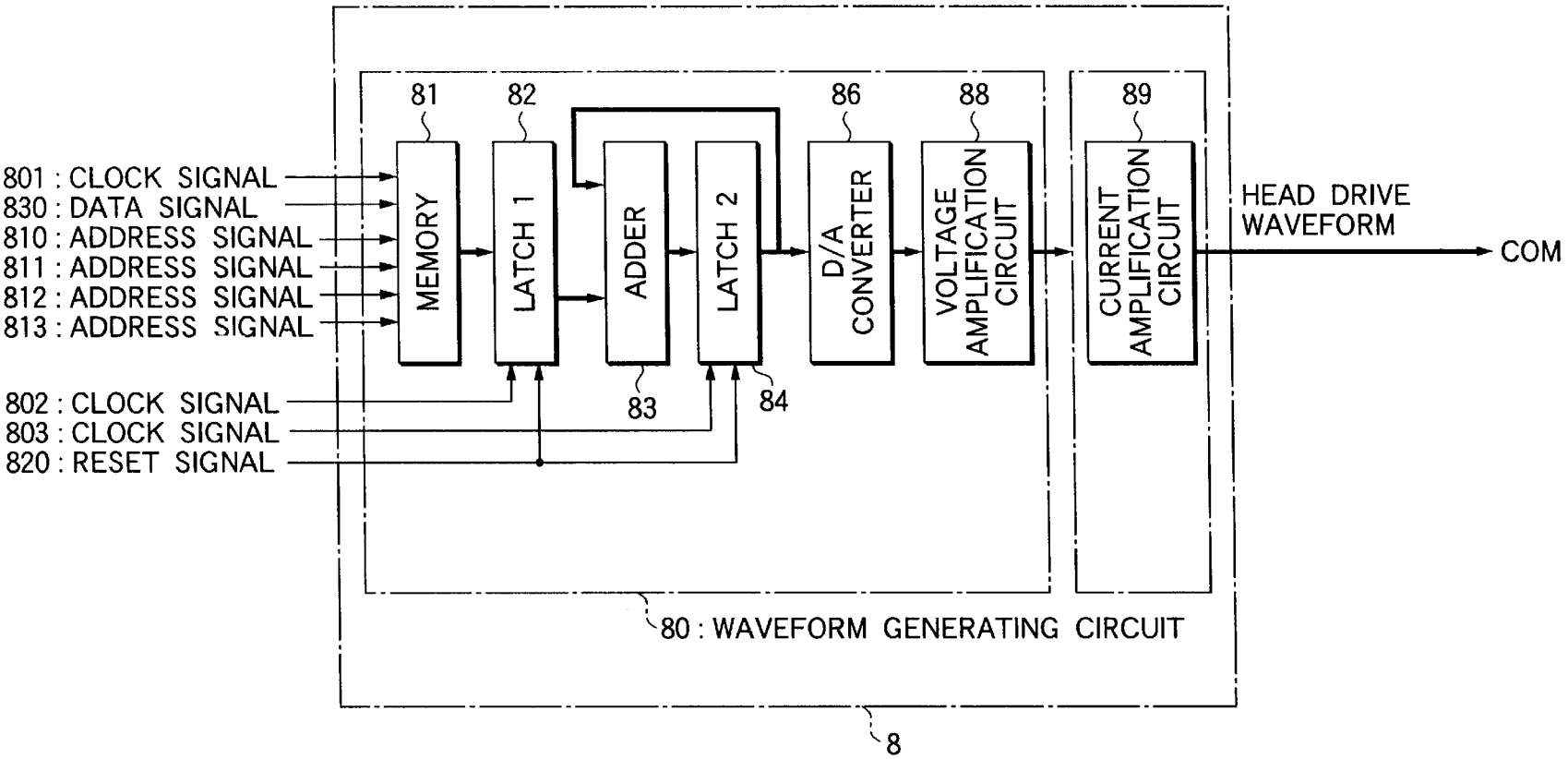
FIG. 3 is a block diagram to show the configuration of a drive signal generating circuit formed in the ink jet recording apparatus shown in FIG. 1.
Figure 4:
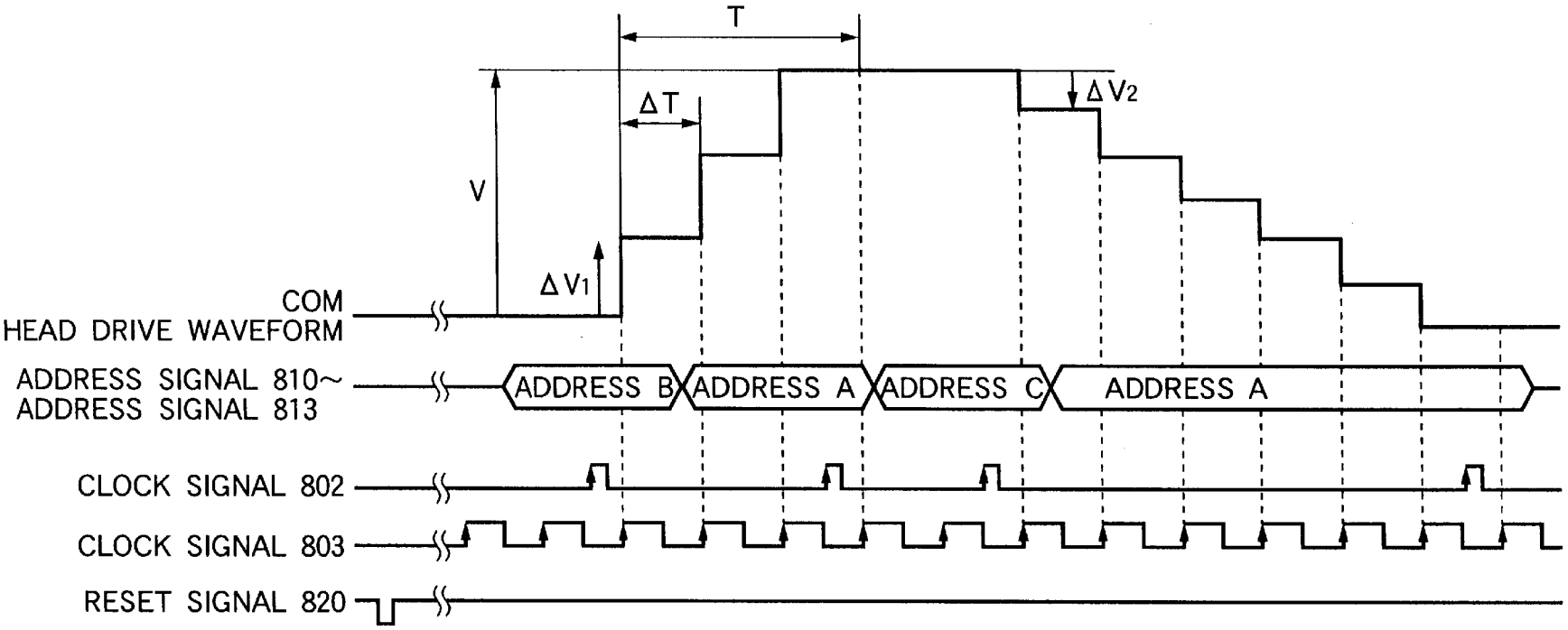
FIG. 4 is a schematic representation to show the process of generating pulses contained in a drive signal in the drive signal generating circuit shown in FIG. 3.
Figure 5:
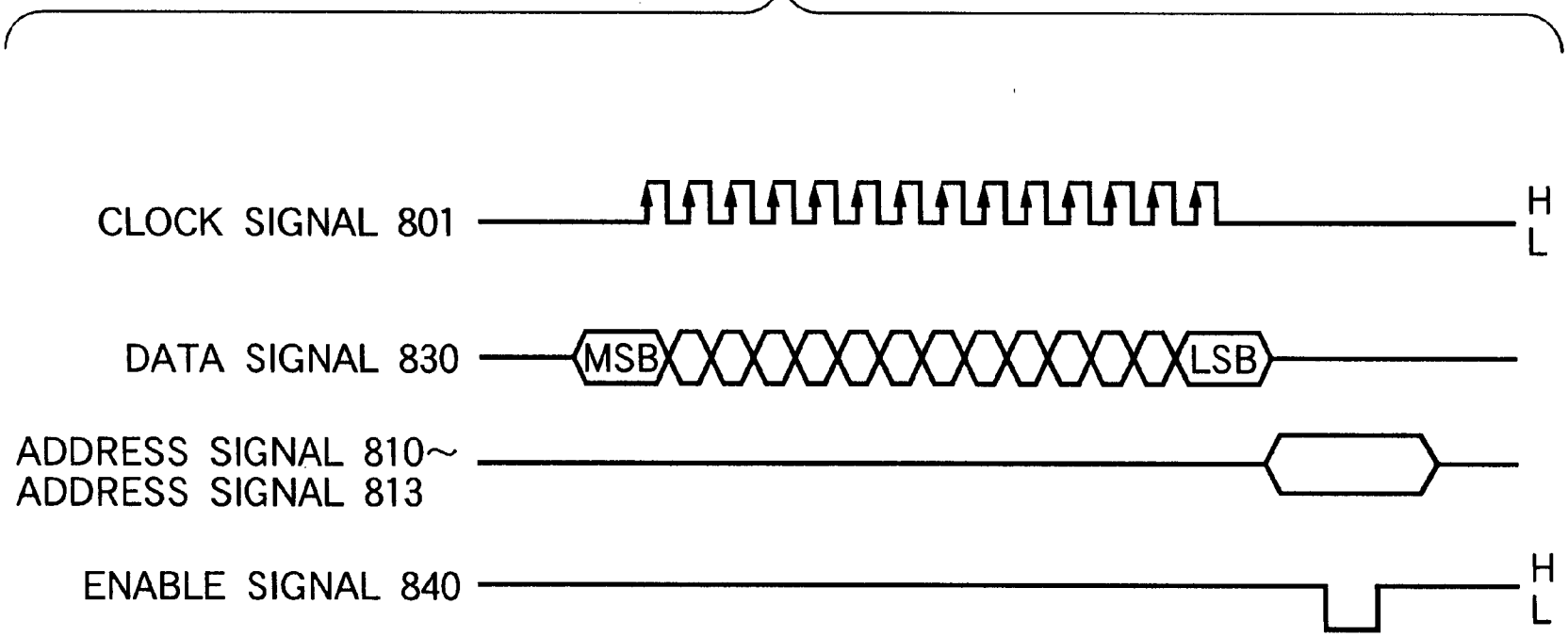
FIG. 5 is a timing chart to show the timings of signals when a data signal is used to set a voltage change amount in memory in the drive signal generating circuit shown in FIG. 3.

FIG. 3 is a block diagram to show the configuration of the drive signal generating circuit 8. FIG. 4 is a schematic representation to show the process of generating pulses contained in a drive signal in the drive signal generating circuit 8. FIG. 5 is a timing chart to show the timings of signals when a data signal is used to set a voltage change amount in memory in the drive signal generating circuit 8.

In FIG. 3, the drive signal generating circuit 8 is mainly made up of a waveform generating circuit 80 for generating the waveform of the drive signal COM and a current amplification circuit 89 for amplifying the current of the signal output from the waveform generating circuit 80 and outputting the result as the drive signal COM. The waveform generating circuit 80 is made up of memory 81 for receiving a signal from the control section 6 and recording the signal, a first latch 82 for reading and temporarily retaining the contents of the memory 81, an adder 83 for adding output of the first latch 82 and output of a second latch 84 described later, a D/A converter 86 for converting output of the second latch 82 into analog data, a voltage amplification circuit 88 for amplifying the provided analog signal to the voltage of the drive signal, and the current amplification circuit 89 for amplifying the current of the drive signal output from the voltage amplification circuit 88 and outputting the result as the drive signal COM. Here, the memory 81 stores predetermined parameters for determining the waveform of the drive signal. The waveform of the drive signal COM is determined by the predetermined parameters previously received from the control section 6, as described later. That is, the waveform generating circuit 80 receives clock signals 801, 802, and 803, a data signal 830, address signals 810, 811, 812, and 813, and a reset signal 820.

In the described drive signal generating circuit 8, as shown in FIG. 4, before the drive signal COM is generated, some data signals indicating the voltage change amount of the control section 6 and the address of the data signal are output to the memory 81 of the drive signal generating circuit 8 in synchronization with the clock signal 801. As shown in FIG. 5, serial transfer of the data signal 830 using the clock signal 801 as a synchronizing signal is executed to transfer data. That is, to transfer a predetermined voltage change amount from the control section 6, first a data signal of a plurality of bits is output in synchronization with the clock signal 801. Then, the address to store the data is output as the address signals 810 to 813 in synchronization with an enable signal 840. The memory 81 reads the address signal at the timing at which the enable signal 840 is output and writes the received data into the address. Since the address signals 810 to 813 are four-bit signal, a maximum of 16 types of voltage change amounts can be stored in the memory 81. The most significant bit of the data is used as a sign.

When address B is output to the address signals 810 to 813 after completion of setting the voltage change amount in each address A, B, . . . , the voltage change amount corresponding to the address B is retained in the first latch 82 based on the first clock signal 802. In this state, if the clock signal 803 is next output, the value of output of the first latch 82 added to output of the second latch 84 is retained in the second latch 84. That is, as shown in FIG. 4, once the voltage change amount corresponding to the address signal is selected, then output of the second latch 84 is incremented or decremented in accordance with the voltage change amount each time the clock signal 803 is received. The voltage change amount of the drive waveform is determined by voltage change amount $\Delta V1$ stored at the address B of the memory 81 and unit time $\Delta T$ of the clock signal 803. Increment or decrement is determined by the sign of data stored at each address.

In the example shown in FIG. 4, a value of 0 as the voltage change amount, namely, the value for maintaining the voltage is stored at address A. Therefore, when the address A is validated by the clock signal 802, the waveform of the drive signal is held flat with no increment or decrement. To determine the voltage change amount of the drive waveform, voltage change amount $\Delta V2$ per unit time $\Delta T$ is stored at address C. Therefore, after the address C is validated by the clock signal 802, the voltage will be decremented by voltage $\Delta V2$.

Thus, the waveform of the drive signal COM can be controlled as desired simply by thus outputting the address signals and the clock signals.

In the described drive signal generating circuit 8, in the embodiment, as shown in FIG. 2, the waveform generating circuit 80 is formed in the apparatus main unit 2 and the current amplification circuit 89 is formed in the recording head 10. Thus, in the drive signal generating circuit 8, the drive signal COM before undergoing current amplification, output from the waveform generating circuit 80 is output to the current amplification circuit 89 in the recording head 10 via the interface 9 and the flexible wiring board 100, but the drive signal COM after undergoing current amplification in the current amplification circuit 89 is not transmitted via the long flexible wiring board 100 connecting the recording head 10 and the apparatus main unit 2.

Thus, in the ink jet recording apparatus 1 of the embodiment, the current amplification circuit 89 corresponding to the last stage in the drive signal generating circuit 8 is formed in the recording head 10, so that the drive signal COM after undergoing current amplification is output to the head drive circuit 18 in the recording head 10 and is not output via the long flexible wiring board 100 connecting the apparatus main unit 2 and the recording head 10. Therefore, the problem of distorting the waveform of the drive signal COM after undergoing current amplification because of parasitic inductance, etc., of the flexible wiring board 100 can be solved. When the recording head 10 is tested for characteristics, the recording head 10 also containing the current amplification circuit 89 of the drive signal generating circuit 8 is tested for characteristics, so that the characteristics of the recording head 10 also containing those of the drive signal generating circuit 8 can be determined properly. Therefore, a proper drive signal COM can be applied to each pressure generating element 17 in the recording head 10.

Configuration of Recording Head and Carriage

Figure 6A:
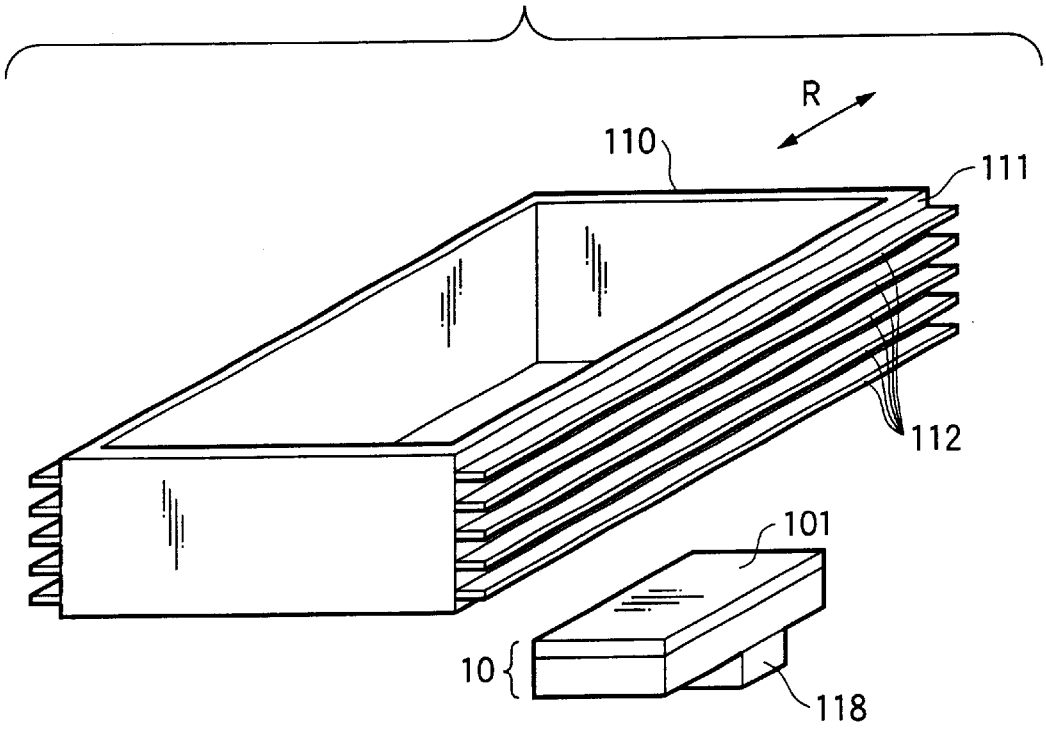
FIGS. 6(A) and (B) are a perspective view when a recording head and a carriage in the ink jet recording apparatus shown in FIG. 1 are disassembled and a bottom view to show a state in which the recording head is attached to the carriage, respectively.
Figure 7A:
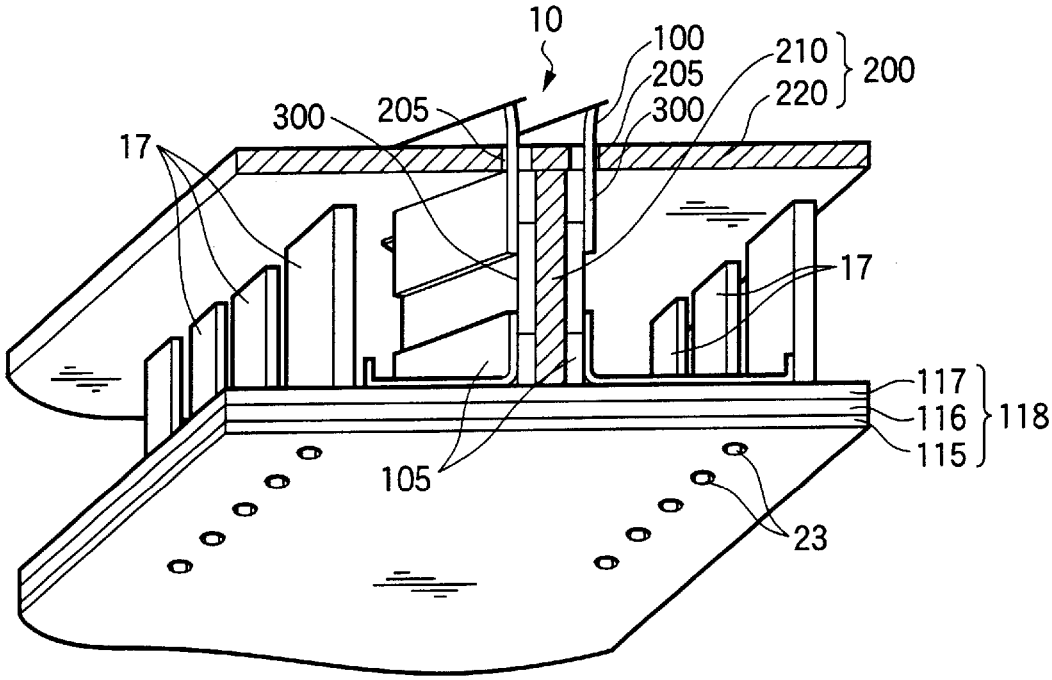
FIGS. 7(A) and (B) are a perspective view to show the main part of the recording head of the ink jet recording apparatus shown in FIG. 1 and a perspective view of a heat radiation member used with the recording head, respectively.
Figure 7B:
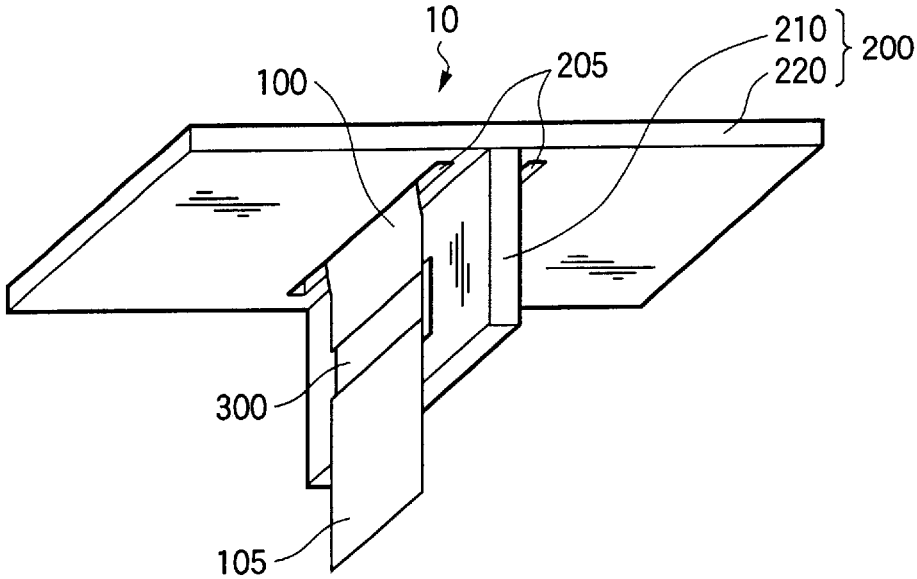

However, when the current amplification circuit 89 is formed in the recording head 10, heat generation in the recording head 10 grows, thus in the embodiment, the following heat radiation measure is taken for the recording head 10:

FIGS. 6(A) and (B) are a perspective view when the carriage 110 and the recording head 10 used with the ink jet recording apparatus 1 of the embodiment are disassembled and a bottom view in a state in which the recording head 10 is attached to the bottom of the carriage 110, respectively. FIGS. 7(A) and (B) are a perspective view to show the main part of the recording head 10 used with the ink jet recording apparatus 1 of. the embodiment and a perspective view of a heat radiation member (heat sink) used with the recording head, respectively.

As shown in FIGS. 6(A) and (B), the carriage 110 comprises a metal case shaped like a rectangular parallelepiped opened in the upper surface thereof and stores an ink cartridge 17 (FIG. 1) inside. Here, a plurality rows of heat radiation fins 112 extended in the horizontal direction are formed on a side portion 111 parallel with the move direction (indicated by the arrow R), of the side portions of the carriage 110. The recording head 10 is attached to the bottom of the carriage 110 and an upper surface portion 101 (attachment face to the carriage 110) of the recording head 10 is a part of the heat radiation member described with reference to FIGS. 7(A) and (B).

As shown in FIGS. 7(A) and (B), in the recording head 10 of the embodiment, a nozzle plate 115 provided with a plurality of nozzle openings 23 as nozzle rows, a flow passage formation board 116, and an elastic board 117 are stacked in order, forming a flow passage unit 118, and the pressure generating elements 17 are mounted on the upper surface of the flow passage unit 118 so as to abut the elastic board 117.

A heat radiation member 200 comprising a metal plate shaped like T in cross section is mounted on the recording head 10. The heat radiation member 200 comprises a horizontal plate section 220 in contact with the lower face of the carriage 111 and a vertical plate section 210 extended so as to be in contact with the area corresponding to the area between the nozzle rows in the flow passage unit 118 from the horizontal plate section 220. Therefore, the heat radiation member 200 can be attached easily to the lower face of the carriage 111 with the horizontal plate section 220 brought into contact with the face of the carriage 111.

Here, a semiconductor IC 300 provided with the head drive circuit 18 and the current amplification circuit 89 (see FIG. 2) is mounted on both faces of the vertical plate section 210 of the heat radiation member 200 and an end part of the flexible wiring board 100 passing through a slit 205 in the horizontal plate section 220 is connected to the semiconductor IC 300. A flexible wiring board 105 considerably short as compared with the flexible wiring board 100 is connected to each row of the pressure generating elements 17 from the semiconductor IC 300.

In the described recording head 10, the current amplification circuit 89 of the drive signal generating circuit 8 installed in the apparatus main unit 2 in the conventional art is formed in the semiconductor IC 300 in the recording head 10, thus the semiconductor IC 300 generates large heat. In the embodiment, however, the semiconductor IC 300 is mounted directly on the heat radiation member 200, so that heat generated by the semiconductor IC 300 is escaped to the side of the carriage 110 through the vertical plate section 210 and the horizontal plate section 220 of the heat radiation member 200, thus a temperature rise in the recording head 10 can be suppressed. Moreover, the carriage 110 is formed on the side portion 111 with the heat radiation fins 112, so that the heat radiation property of the carriage 110 is also high. Therefore, if the semiconductor IC 300 generating large heat is installed in the recording head 10, the heat of the semiconductor IC 300 is radiated efficiently, so that the reliability of the semiconductor IC 300 can be enhanced. Since a temperature rise in the recording head 10 is suppressed, a problem of drying ink in the recording head 10 because of heat of the semiconductor IC 300 or the like does not occur.

Moreover, the vertical plate section 210 of the heat radiation member 200 abuts the area corresponding to the area between the nozzle rows of the flow passage unit 118 and is fixedly secured. Thus, if the elastic plate 117 is vibrated on the side of one nozzle row, the vibration is not transmitted to the elastic plate 117 positioned on the adjacent nozzle row. Therefore, in the ink jet recording apparatus 1 of the embodiment, the heat radiation member 200 can prevent a temperature rise in the recording head 10 and can also prevent interference between the nozzle rows.

Second Embodiment

Figure 8:
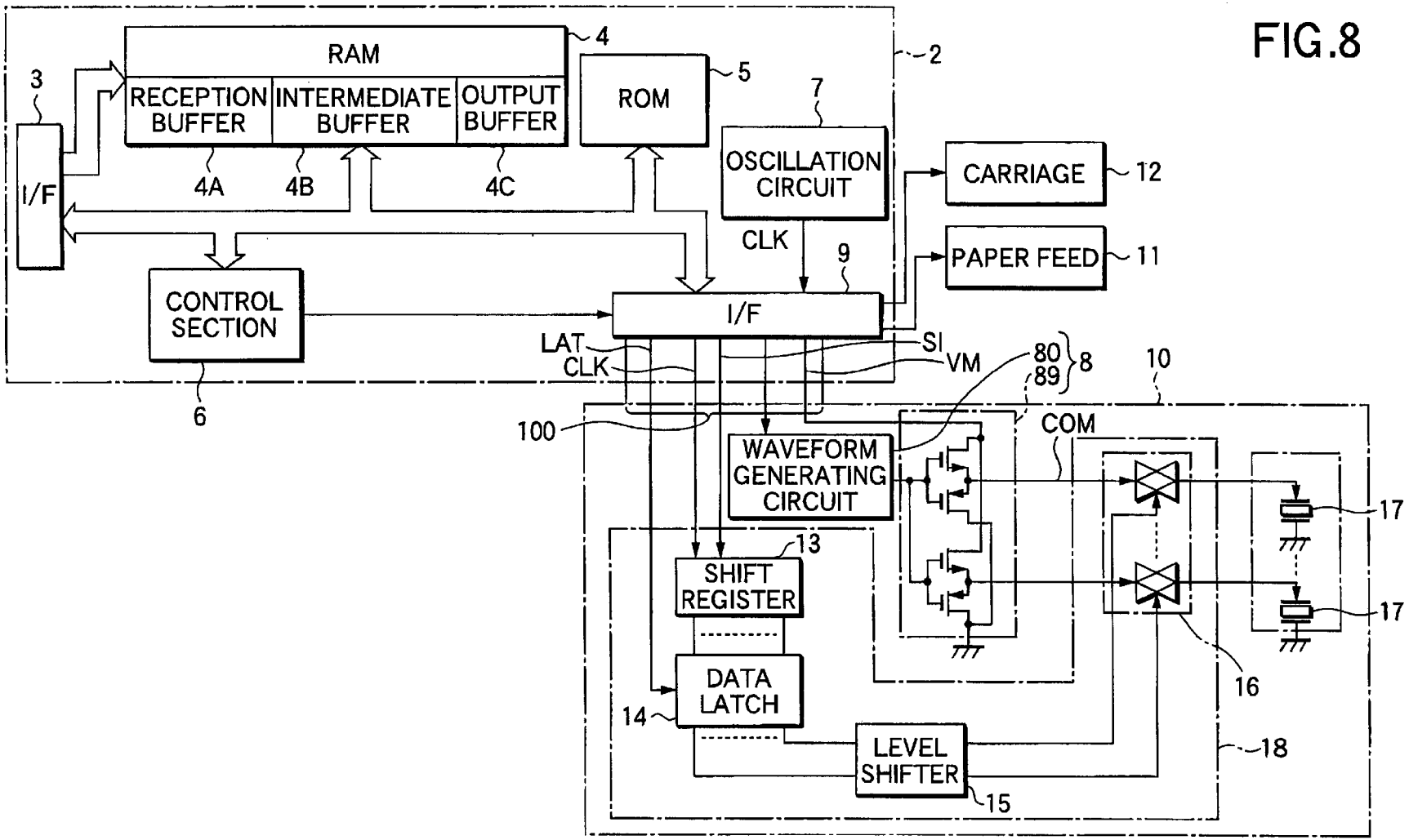
FIG. 8 is a functional block diagram of an ink jet recording apparatus according to a second embodiment of the present invention.

FIG. 8 is a functional block diagram of an ink jet recording apparatus of a second embodiment of the present invention.

In the first embodiment, in the drive signal generating circuit 8, the waveform generating circuit 80 is formed in the apparatus main unit 2 and the current amplification circuit 89 is formed in the recording head 10; in the second embodiment, both a waveform generating circuit 80 and a current amplification circuit 89 are formed in a recording head 10, as shown in FIG. 8. Therefore, in the embodiment, the waveform generating circuit 80 receives the clock signals 801, 802, and 803, data signal 830, address signals 810, 811, 812, and 813, and reset signal 820, and the like previously described with reference to FIG. 3 from a control section 6 of a apparatus main unit 2 via a flexible wiring board 100. In the embodiment, the waveform generating circuit 80 and the current amplification circuit 89 are formed in the semiconductor IC 300 shown in FIGS. 7(A) and (B) together with a head drive circuit 18.

Since in the ink jet recording apparatus 1 of the embodiment, both the waveform generating circuit 80 and the current amplification circuit 89 of a drive signal generating circuit 8 are formed in the recording head 10, both drive signal COM before undergoing current amplification, output from the waveform generating circuit 80 and the drive signal COM after undergoing current amplification, output from the current amplification circuit 89 are output to the head drive circuit 18 in the recording head 10. Therefore, the drive signals COM before and after undergoing current amplification are not output via a long flexible wiring board 100 connecting the apparatus main unit 2 and the recording head 10. Therefore, the problem of distorting the waveforms of the drive signals COM before and after undergoing current amplification because of parasitic inductance, etc., of the flexible wiring board 100 can be solved. When the recording head 10 is tested for characteristics, the recording head 10 also containing the waveform generating circuit 80 and the current amplification circuit 89 of the drive signal generating circuit 8 is tested for characteristics, so that the characteristics of the recording head 10 also containing those of the drive signal generating circuit 8 can be determined properly. Therefore, a proper drive signal COM can be applied to each pressure generating element 17 in the recording head 10.

Figure 12:
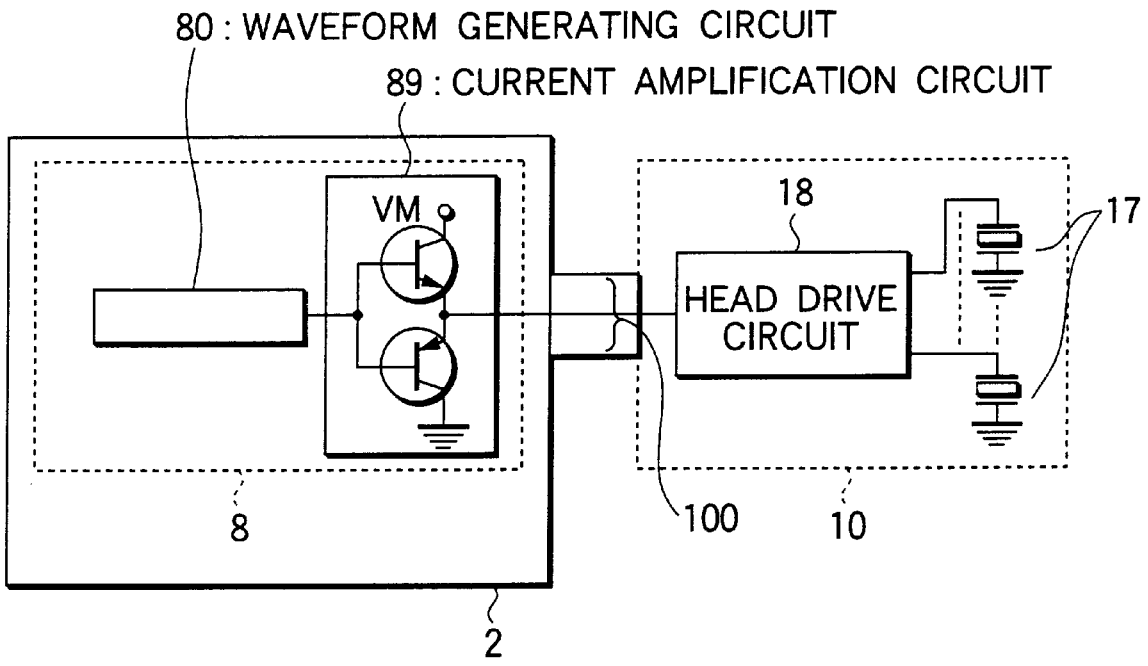
FIG. 12 is a functional block diagram of an ink jet recording apparatus in a conventional art.

In the recording head 10 of the first embodiment described above, the current amplification circuit 89 of the drive signal generating circuit 8 is formed in the semiconductor IC 300 in the recording head 10, thus heat generation of the semiconductor IC 300 becomes large as compared with the conventional art example previously described with FIG. 12. In the recording head 10 of the second embodiment described, both the waveform generating circuit 80 and the current amplification circuit 89 of the drive signal generating circuit 8 are formed in the semiconductor IC 300 in the recording head 10, thus heat generation of the semiconductor IC 300 furthermore grows as compared with that in the first embodiment. In this case, if a structure of absorbing the generated heat in ink flowing through the ink lead passage 245 is adopted as one of the heat radiation measures against heat generation of the semiconductor IC 300 as described with reference to FIGS. 13(A) and (B) for the conventional art example (conversely, both the waveform generating circuit 80 and the current amplification circuit 89 of the drive signal generating circuit 8 are placed in the semiconductor IC 249 in the conventional art example described with reference to FIGS. 13(A) and (B)), heat generation of the semiconductor IC 300 reaches about three W (watts) to 15 W (watts), thus the temperature may become 100° C. to 150° C. and ink would come to a boil with no measures taken. As a result, a serious problem such that entirely separate pressure not corresponding to the drive signal occurs in the pressure generating chamber 234 because of a bubble produced by boiling the ink, jetting an ink drop, etc., may be incurred.

Figure 9A:
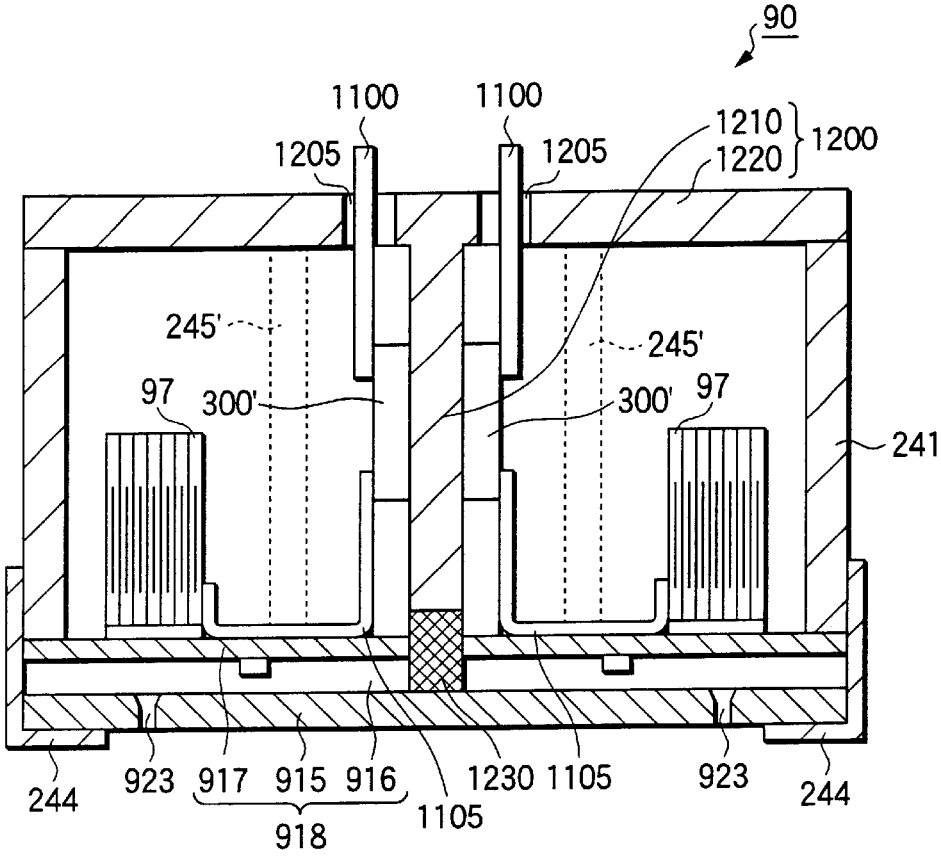
FIGS. 9(A) and (B) are a sectional view and a bottom view of a recording head of the ink jet recording apparatus according to the second embodiment of the present invention respectively.
Figure 9B:
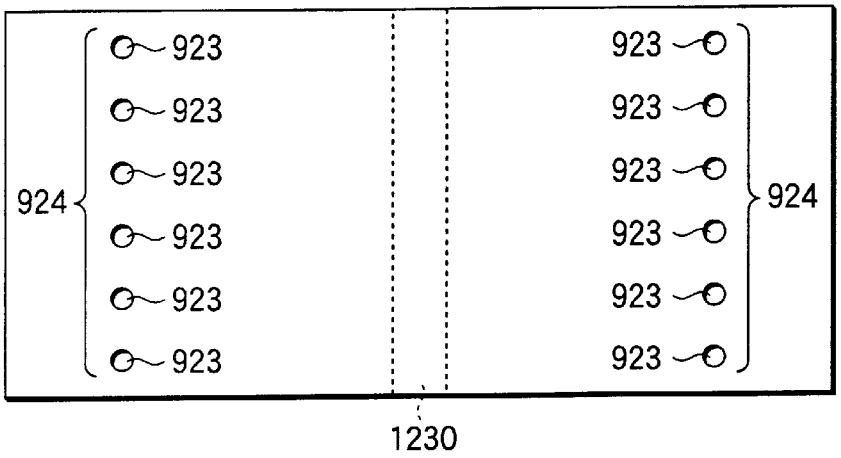

Then, in the second embodiment, the following heat radiation measure is taken for the recording head 10: FIGS. 9(A) and (B) show a schematic structure of recording head of the second embodiment. As shown in FIGS. 9(A) and (B), in the recording head 90 of the second embodiment, a nozzle plate 915 provided with a plurality of nozzle openings 923 as nozzle rows 924, a flow passage formation board 916, and an elastic board 917 are stacked in order, forming a flow passage unit 918, and pressure generating elements 97 are mounted on the upper surface of the flow passage unit 918 so as to abut the elastic board 917.

Figure 6B:
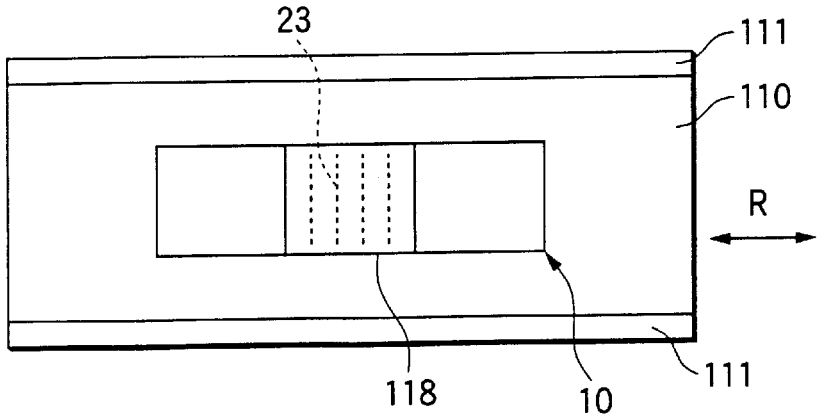

A heat radiation member 1200 comprising a metal plate (for example, aluminum) shaped like T in cross section is mounted on the recording head 90. The heat radiation member 1200 comprises a horizontal plate section 1220 in contact with the lower face of a carriage 911 and a vertical plate section 1210 orthogonal to the horizontal plate section 1220 and extended toward the flow passage unit 918. The heat radiation member 1200 can be attached easily to the lower face of the carriage 110 (see FIG. 6) with the horizontal plate section 1220 brought into contact with the face of the carriage.

Here, a semiconductor IC 300' provided with the head drive circuit 18, the current amplification circuit 89, and the waveform generating circuit 80 is mounted on both faces of the vertical plate section 1210 of the heat radiation member 1200 and an end part of a flexible wiring board 1100 passing through a slit 1205 in the horizontal plate section 1220 is connected to the semiconductor IC 300'. A flexible wiring board 1105 considerably short as compared with the flexible wiring board 1100 is connected to each row of the pressure generating elements 97 from the semiconductor IC 300'.

Figure 13A:
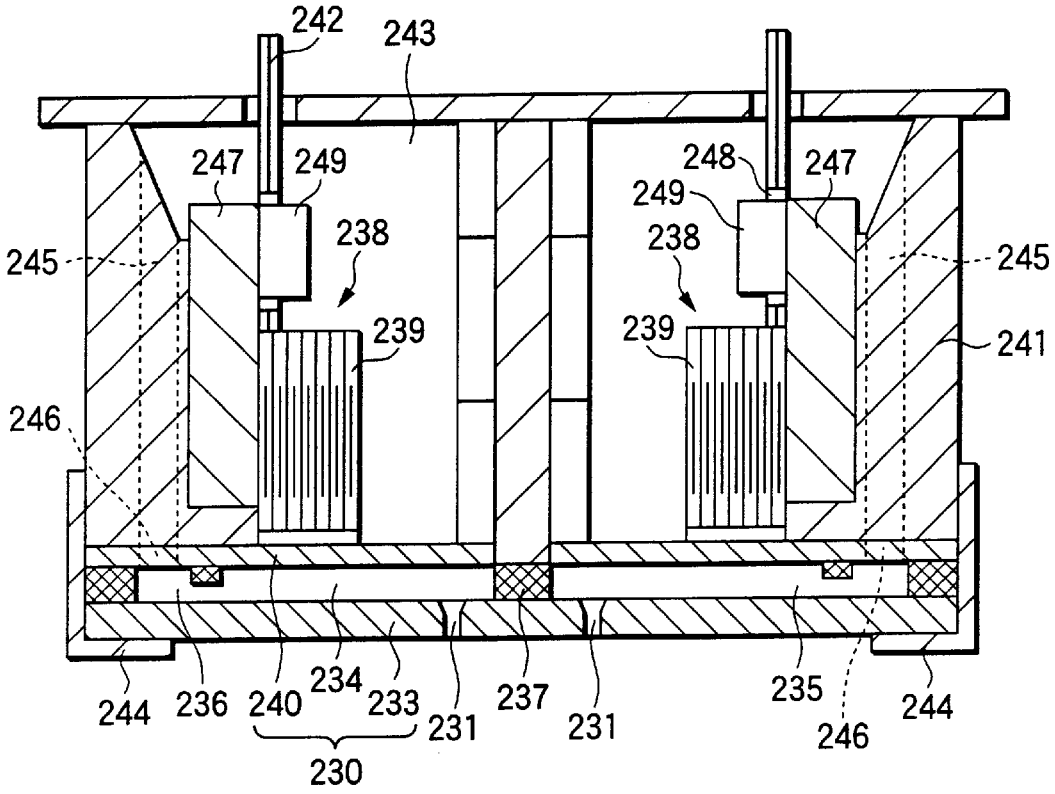
FIGS. 13(A) and (B) are a sectional view and a bottom view of a recording head of the ink jet recording apparatus in the conventional art respectively.
Figure 13B:
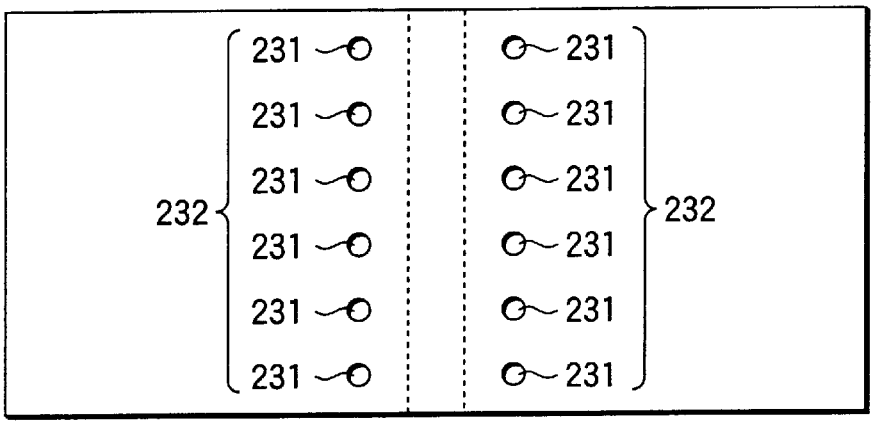

In the conventional art example shown in FIG. 13(A), heat generated by the semiconductor IC 249 (heat source) is radiated mainly through the fix board 247. In contrast, in the ink jet recording apparatus of the embodiment, heat is radiated through the heat radiation member 1200 having a larger surface area of heat radiation. A heat insulation material 1230 is attached to the lower end of the vertical plate section 1210 of the heat radiation member 1200. The heat insulation material 1230 is in contact with the area corresponding to the area between the nozzle rows 924. Therefore, the heat insulation material 1230 thermally insulates the vertical plate section 1210 and the flow passage formation board 916. Thus, the heat generated by the semiconductor IC 300' (heat source) is escaped upwardly (ink tank side) through the vertical plate section 1210 of the heat radiation member 1200 and is effectively radiated through the horizontal plate section 1220 of the heat radiation member 1200 and further heat radiation fins 112, etc., of the carriage 110. Since the heat insulation material 1230 is provided, the heat generated by the semiconductor IC 300' (heat source) can be efficiently prevented from being transmitted to the ink flow passage. For example, if materials such that the heat resistance ratio between the heat insulation material 1230 and the heat radiation member 1200 becomes 9:1 are selected (if the heat radiation member 1200 is made of aluminum, a heat insulation material having heat resistance nine times that of aluminum is selected), the heat generated,by the semiconductor IC 300' (heat source) can be escaped upwardly (ink tank side) at a ratio of 9:1 if other elements (portion circulated by convection into air from the surface of the semiconductor IC 300' and radiated and the like) are not considered. Preferably, the heat resistance ratio between the heat insulation material 1230 and the heat radiation member 1200 becomes 4:1 or more, because even if the heat generated by the semiconductor IC 300' becomes 150° C., the heat transmitted to the flow passage unit side can be suppressed to ⅕ or less if other elements are not considered.

As shown in FIG. 9A, an ink lead passage 245' is formed away from the semiconductor IC 300' (heat source) and extended up and down roughly midway between the pressure generating element 97 and the semiconductor IC 300'. In the conventional art example shown in FIG. 13(A), the ink lead passage 245 is placed close to the semiconductor IC 249 (heat source) via the fix board 247 having high heat conductivity. In contrast, in the ink jet recording apparatus of the embodiment, the ink lead passage 245' is placed away from the semiconductor IC 300' (heat source), so that the heat generated by the semiconductor IC 300' (heat source) can also be prevented from being transmitted to the ink flow passage according to the placement. To furthermore suppress heat conduction to the ink lead passage 245', it is also possible to wind the surroundings of the semiconductor IC 300' with heat insulation tape made of a resin, etc. In doing so, the above-mentioned portion circulated by convection into air from the surface of the semiconductor IC 300' and radiated can be made extremely small, so that it is also made possible to escape heat to the upper side (ink tank side) more reliably.

In the nozzle plate 915, the nozzle rows 924 each formed with a plurality of nozzle openings 923 are formed on the outer side from the ink lead passage 245' (frame 244 side) and the adjacent nozzle rows 924 and 924 are placed largely away from each other, as shown in FIGS. 9(A) and (B). As a result, if the ink lead passage 245' is placed at the center, the ink flow passage to each nozzle opening 923 can be provided comparatively long, so that a temperature rise of ink can be easily avoided. The adjacent nozzle rows 924 and 924 are placed largely away from each other. Thus, if the elastic plate 917 is vibrated on the side of one nozzle row 924, the vibration is not transmitted to the elastic plate 917 positioned on the other adjacent nozzle row 924. Therefore, in the ink jet recording apparatus of the embodiment, interference between the nozzle rows can also be prevented.

As described above, in the recording head 90 of the embodiment, all of the head drive circuit 18, the current amplification circuit 89, and the waveform generating circuit 80 are formed in the semiconductor IC 300' in the recording head 90, thus heat generation of the semiconductor IC 300' becomes very large, but the heat of the semiconductor IC 300 is radiated efficiently, so that the reliability of the semiconductor IC 300' can be enhanced. Since a temperature rise in the recording head 90 is suppressed, boiling of ink due to heat of the semiconductor IC 300' does not occur.

Third Embodiment

An ink jet recording apparatus according to a third embodiment of the present invention will be discussed with reference to FIG. 10.

In the ink jet recording apparatus according to the embodiment, a plurality of rows of heat radiation fins 112 extended in the horizontal direction are formed on a side portion 111 parallel with a move direction of a carriage 110' (direction perpendicular to the paper face in FIG. 10), of side portions of the carriage 110', as in the first and third embodiments. A recording head 400 of the ink jet recording apparatus according to the embodiment is attached to the bottom of the carriage 110' and an upper surface portion 402 of the recording head 400 (attachment face to the carriage 110') is a portion similar to the horizontal plate section 1220 of the heat radiation member 1200 in the third embodiment described above and produces a heat radiation effect. The internal structure of the recording head 400 is similar to that of the recording head 90 in the third embodiment described above and therefore will not be illustrated or discussed again in detail.

Figure 10:
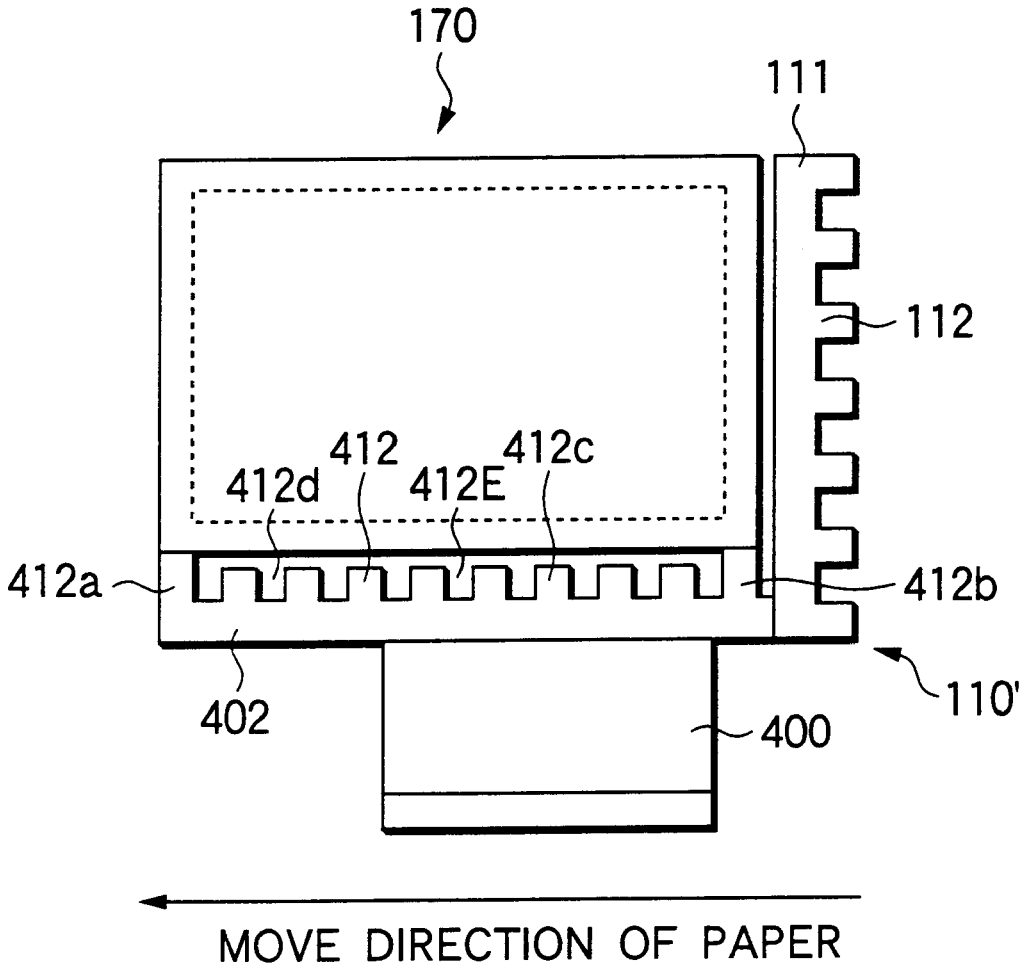
FIG. 10 is a drawing to describe a recording head and a carriage of an ink jet recording apparatus according to a third embodiment of the present invention.

As shown in FIG. 10, a plurality of rows of heat radiation fins 412 extended in the move direction of the carriage 110' (direction perpendicular to the paper face in FIG. 10) are formed on the upper surface portion 402 (a horizontal plate section 1220' of a heat radiation member 1200) of the recording head 400 in the embodiment. Fins 412*a* and 412*b* at both ends of a plurality of rows of heat radiation fins 412 are formed slightly higher than a plurality of other fins 412*c* and serve a function of supporting an ink cartridge 170 (see FIG. 1) mounted on the upper portion. Therefore, not only a gap 412*d* between other fins 412*c,* but also a space 412E between a plurality of other fins 412*c* and the bottom of the ink cartridge 170 is formed.

In the recording head 400 of the embodiment, a plurality of rows of heat radiation fins 412 are also formed on the upper surface portion 402 (the horizontal plate section 1220' of the heat radiation member 1200) and the heat radiation effect is more enhanced. In addition, when the carriage 110' is moved (reciprocated in the direction perpendicular to the paper face in FIG. 10) by main scanning during printing, an air flow occurs (wind flows) in each gap 412*d* between the fins 412*c* and further the space 412E between a plurality of fins 412*c* and the bottom of the ink cartridge 170 in response to the move speed of the carriage 110', so that the effect of air cooling of the heat radiation member 1200 is produced because of the air flow.

The carriage 110' has a structure with an opening in the front direction of the ink jet recording apparatus (front in the move direction of paper indicated by the arrow) for making it easy to remove an empty ink cartridge and attach a new ink cartridge at the replacement time of the ink cartridge 170, etc. Recently, a general printer of an ink jet recording apparatus (printer), etc., has been often placed at the uppermost stage of a personal computer rack, etc. If a printer is placed at a high place, such as the uppermost stage of a personal computer rack, etc., replacement of an ink cartridge is facilitated by adopting the structure with an opening in the front direction of the carriage 110'.

Fourth Embodiment

Figure 11A:
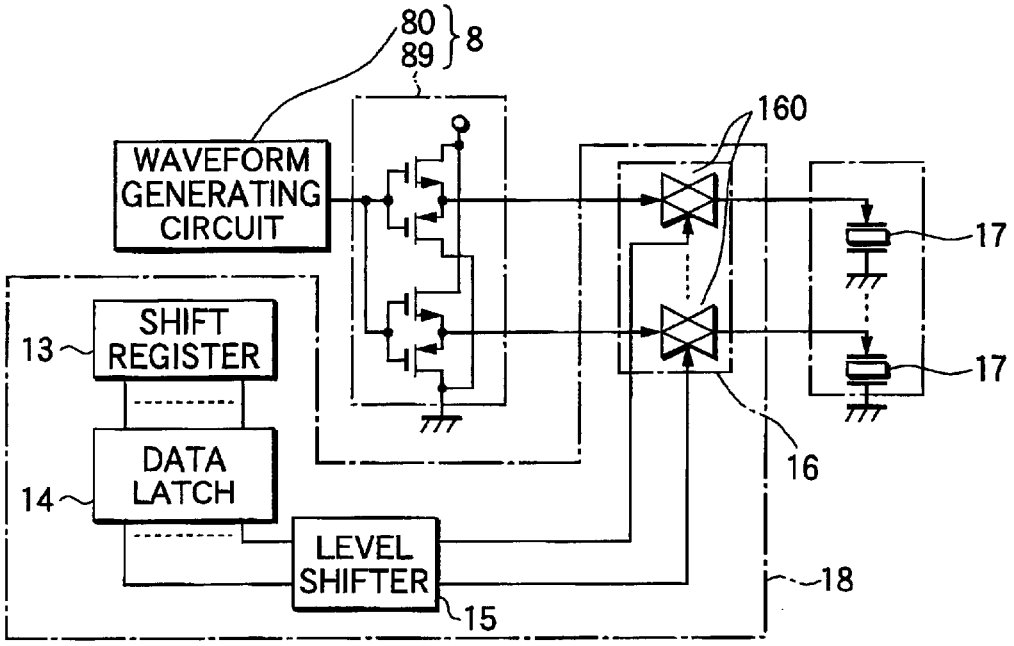
FIGS. 11(A) and (B) are a block diagram to show a general circuit configuration in an ink jet recording apparatus and a block diagram to show the feature of a circuit configuration in an ink jet recording apparatus according to a fifth embodiment of the present invention respectively.
Figure 11B:
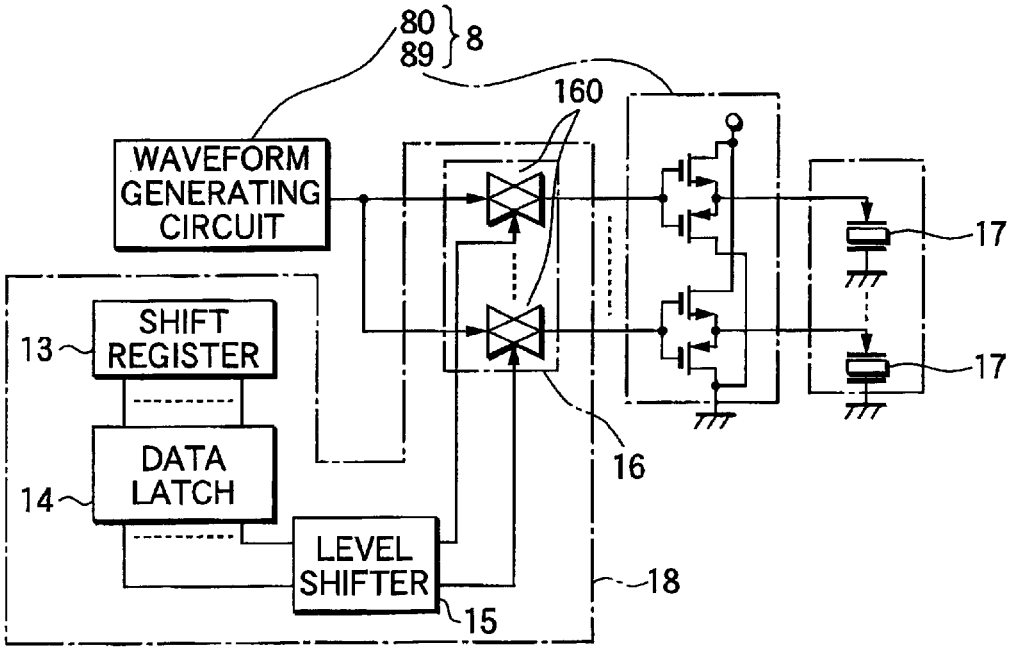

FIGS. 11(A) and (B) are a block diagram to show a general circuit configuration in an ink jet recording apparatus and a block diagram to show the feature of a circuit configuration of a fourth embodiment of the present invention respectively. The embodiment can be applied to both the first and second embodiments described above and other components are similar to those of the first and second embodiments. Therefore, FIG. 11(B) shows only the feature of the embodiment.

In the ink jet recording apparatuses of the embodiments and the ink jet recording apparatus in the conventional art described above, as shown in FIG. 11(A), output of the waveform generating circuit 80 is input into the current amplification circuit 89 and the signal after undergoing current amplification in the current amplification circuit 89 is input into each switching element 160 (analog switch) of the switch circuit 16 of the head drive circuit 18. In the embodiment, as shown in FIG. 11(B), using the fact that a current amplification circuit 89 is formed in a recording head 10, output of a waveform generating circuit 80 is input into the current amplification circuit 89 via each switching element 160 (analog switch) of a switch circuit 16 of a head drive circuit 18. The waveform generating circuit 80 may be formed in either main apparatus unit (in the first embodiment) or the recording head 10 (in the second embodiment).

In the described ink jet recording apparatus, a signal before undergoing current amplification is input into the switching elements 160 of the switch circuit 16 of the head drive circuit 18, thus heat generation of the switching elements 160 is small. Therefore, the reliability of the switching elements 160 can be enhanced and small-sized elements can be used as the switching elements 160. Although the present invention has been described in the specific embodiments, it is understood that the present invention is not limited to the specific embodiments and is applied to other embodiments within its spirit and scope as set out in the accompanying claims.

For example, in the above-described embodiments, piezoelectric vibrators are used as the pressure generating elements 17, but the pressure generating elements 17 are not limited to the piezoelectric vibrators and magnetostrictive elements, etc., may be used. Further, the present invention can also be applied to an ink jet recording apparatus of so-called bubble jet type using heating elements as the pressure generating elements.

As described above, in the ink jet recording apparatus according to the present invention, at least the current amplification circuit of the drive signal generating circuit is formed in the recording head, so that the drive signal after undergoing current amplification is output to the head drive circuit in the recording head and is not output via the flexible wiring board connecting the apparatus main unit and the recording head. Therefore, the problem of distorting the waveform of the drive signal after undergoing current amplification because of parasitic inductance, etc., of the flexible wiring board can be solved. When the recording head is tested for characteristics, the recording head also containing the current amplification circuit of the drive signal generating circuit is tested for characteristics, so that the characteristics of the recording head also containing those of the drive signal generating circuit can be determined properly. Therefore, a proper drive signal can be applied to each pressure generating element in the recording head.

Since the current amplification circuit is formed in the recording head, heat generation of the recording head becomes large, but the heat radiation member is placed in the recording head, so that a temperature rise in the recording head can be prevented. Therefore, in the recording head, each circuit can be prevented from malfunctioning or being degraded because of heat, and the detrimental effect of hastening drying of ink in the presence of heat or the like can be avoided. Further, in the ink jet recording apparatus according to the present invention, the head drive circuit, the current amplification circuit, and the waveform generating circuit are formed so as to be contained in the semiconductor device of the recording head, the heat radiation member for the semiconductor device comprises at least a horizontal plate section in face contact with a carriage on which the recording head is mounted and a vertical plate section extended from the horizontal plate section to the flow passage unit, the semiconductor device is mounted on the vertical plate section, and further, a first heat insulation material is attached between the vertical plate section of the heat radiation member and the area corresponding to the area between the nozzle rows in the flow passage unit. The first heat insulation material thermally insulates the vertical plate section and the flow passage unit and the heat generated by the semiconductor device of the recording head is escaped upwardly through the vertical plate section of the heat radiation member and is effectively radiated through the horizontal plate section of the heat radiation member. Since the heat insulation material is provided, the heat generated by the semiconductor device can be efficiently prevented from being transmitted to the ink flow passage.

What is claimed is:

1. An ink jet recording apparatus comprising a recording head comprising a plurality of pressure generating elements for pressurizing ink in pressure generating chambers, thereby jetting ink drops from nozzle openings and a head drive circuit for selecting which of the plurality of pressure generating elements a drive signal is to be applied to based on recording data and a drive signal generating circuit for outputting the drive signal, said drive signal generating circuit comprising at least a waveform generating circuit for generating the drive signal and a current amplification circuit for executing current amplification of the drive signal generated by the waveform generating circuit and outputting the result, characterized in that the current amplification circuit is formed on a side of said recording head.

2. The ink jet recording apparatus as claimed in claim 1, characterized in that said recording head has a heat radiation member for the current amplification circuit.

3. The ink jet recording apparatus as claimed in claim 1, characterized in that the waveform generating circuit is also formed on the side of said recording head.

4. The ink jet recording apparatus as claimed in claim 3, characterized in that said recording head has a heat radiation member for the current amplification circuit and the waveform generating circuit.

5. The ink jet recording apparatus as claimed in any of claim 1 to 4, characterized in that the nozzle openings are formed in a flow passage unit as a plurality of nozzle rows in parallel, and the heat radiation member is in contact with at least an area corresponding to an area between the plurality of nozzle rows in the flow passage unit.

6. The ink jet recording apparatus as claimed in claim 5, characterized in that the heat radiation member comprises at least a horizontal plate section in face contact with a carriage on which said recording head is mounted and a vertical plate section extended so as to be in contact with the area corresponding to the area between the nozzle rows in the flow passage unit from the horizontal plate section, and a semiconductor device, in which at least the head drive circuit and the current amplification circuit are formed, is mounted onto the vertical plate section.

7. The ink jet recording apparatus as claimed in claim 6, characterized in that heat radiation fins are formed in the carriage.

8. The ink jet recording apparatus as claimed in any of claims 1 to 7, characterized in that output of the waveform generating circuit is input into the current amplification circuit via switching-elements of the head drive circuit.

9. An ink jet recording apparatus comprising a recording head comprising a plurality of pressure generating elements for pressurizing ink introduced into pressure generating chambers via an ink lead passage, thereby jetting ink drops from nozzle openings and a semiconductor device containing a head drive circuit for selecting which of the plurality of pressure generating elements a drive signal is to be applied to based on recording data and a drive signal generating circuit for outputting the drive signal, said drive signal generating circuit comprising at least a waveform generating circuit for generating the drive signal and a current amplification circuit for executing current amplification of the drive signal generated by the waveform generating circuit and outputting the result, characterized in that the current amplification circuit and the waveform generating circuit are also formed so as to be contained in the semiconductor device of said recording head, and said recording head has a heat radiation member for the semiconductor device.

10. The ink jet recording apparatus as claimed in claim 9, characterized in that the heat radiation member comprises at least a horizontal plate section in face contact with a carriage on which said recording head is mounted and a vertical plate section extended from the horizontal plate section to the flow passage unit, and the semiconductor device is mounted onto the vertical plate section.

11. The ink jet recording apparatus as claimed in claim 10, characterized in that a first heat insulation material is attached between the vertical plate section of the heat radiation member and an area corresponding to an area between the nozzle rows in the flow passage unit.

12. The ink jet recording apparatus as claimed in claim 11, characterized in that the heat resistance ratio between the first heat insulation material and the heat radiation member is at least larger than 4:1.

13. The ink jet recording apparatus as claimed in any of claims 9 to 12, characterized in that the ink lead passage is placed away from the semiconductor device.

14. The ink jet recording apparatus as claimed in claim 13, characterized in that the ink lead passage is placed so as to be extended up and down between the semiconductor device and the pressure generating element.

15. The ink jet recording apparatus as claimed in claim 14, characterized in that surroundings of the semiconductor device are covered with a second heat insulation material.

16. The ink jet recording apparatus as claimed in claim 10, characterized in that first heat radiation fins are formed in the carriage.

17. The ink jet recording apparatus as claimed in claim 16, characterized in that second heat radiation fins are formed on the upper surface side of the horizontal plate section of the heat radiation member.

18. The ink jet recording apparatus as claimed in claim 17, characterized in that the second heat radiation fins are formed in parallel in a move direction of the carriage, other fins are formed lower than the two fins at both ends so that only the two fins at both ends support an ink tank made of a resin for supplying ink to the ink lead passage of said recording head, and a space is provided between other fins and a bottom of the ink tank.

19. The ink jet recording apparatus as claimed in claim 18, characterized in that the carriage is opened in a front direction so that the ink tank can be attached and detached from the front direction of the carriage.

* * * * *